US011428230B2

(12) United States Patent
Davis et al.

(10) Patent No.: US 11,428,230 B2
(45) Date of Patent: Aug. 30, 2022

(54) CENTRIFUGAL PUMP FLANGED SLEEVE INSIDE SURFACE FLOW PREVENTION

(71) Applicant: Halliburton Energy Services, Inc., Houston, TX (US)

(72) Inventors: Gregory Austin Davis, Tulsa, OK (US); Joseph Michael Munoz, Odessa, TX (US); Jeffrey G. Frey, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 296 days.

(21) Appl. No.: 16/591,037

(22) Filed: Oct. 2, 2019

(65) Prior Publication Data

US 2021/0102542 A1 Apr. 8, 2021

(51) Int. Cl.

| | |
|---|---|
| ***F04D 13/08*** | (2006.01) |
| ***F04D 29/08*** | (2006.01) |
| ***F04D 29/42*** | (2006.01) |

(52) U.S. Cl.

CPC ..... *F04D 13/08* (2013.01); *F04D 29/086* (2013.01); *F04D 29/426* (2013.01)

(58) Field of Classification Search

CPC ..... F04D 29/10; F04D 29/106; F04D 29/086; F04D 29/426; F04D 13/06; F04D 13/10; F04D 29/04; F04D 29/043; F04D 29/046; F04D 29/08; F04D 29/12; F04D 29/126

See application file for complete search history.

(56) References Cited

U.S. PATENT DOCUMENTS

| | | | | |
|---|---|---|---|---|
| 3,228,342 | A | 1/1966 | Page | |
| 4,380,416 | A | 4/1983 | Menager | |
| 7,575,413 | B2 * | 8/2009 | Semple | F04D 1/063 415/107 |
| 8,651,836 | B2 * | 2/2014 | Parmeter | F04D 29/047 417/423.12 |
| 10,683,868 | B2 * | 6/2020 | Nowitzki | F04D 29/04 |
| 11,162,339 | B2 * | 11/2021 | Lastra Melo | E21B 23/02 |
| 2015/0023815 | A1 * | 1/2015 | Tetzlaff | F04D 1/04 417/365 |
| 2015/0226219 | A1 * | 8/2015 | Johnson | F04D 13/10 417/423.3 |

(Continued)

FOREIGN PATENT DOCUMENTS

| | | | | |
|---|---|---|---|---|
| EP | 3208462 | A1 * | 8/2017 | F04D 1/06 |
| WO | 2017024067 | A1 | 2/2017 | |

OTHER PUBLICATIONS

Foreign Communication from Related Application—International Search Report and Written Opinion of the International Searching Authority, International Application No. PCT/US2019/058588, dated Jul. 1, 2020, 11 pages.

*Primary Examiner* — Charles G Freay
*Assistant Examiner* — Chirag Jariwala
(74) *Attorney, Agent, or Firm* — Conley Rose, P.C.; Rodney B. Carroll

(57) ABSTRACT

A centrifugal electric submersible pump (ESP). The centrifugal ESP comprises a rotatable shaft, a series of impellers stacked on the rotatable shaft, each impeller comprising a hub secured to the rotatable shaft by a key, the series of impellers comprising an uppermost impeller and a lowermost impeller, a flanged sleeve keyed to the rotatable shaft below the lowermost impeller, and a seal disposed between the lowermost impeller and the flanged sleeve.

20 Claims, 13 Drawing Sheets

(56) References Cited

U.S. PATENT DOCUMENTS

| | | | | |
|---|---|---|---|---|
| 2016/0115998 | A1* | 4/2016 | Jayaram | F04D 13/10<br>417/423.3 |
| 2017/0241428 | A1* | 8/2017 | Ye | F16J 15/3284 |
| 2021/0048029 | A1* | 2/2021 | Ye | F04D 29/047 |
| 2021/0071683 | A1* | 3/2021 | Nowitzki | F04D 29/648 |

* cited by examiner

CENTRIFUGAL PUMP FLANGED SLEEVE INSIDE SURFACE FLOW PREVENTION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Fluid, such as gas, oil or water, is often located in underground formations. When pressure within the well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a non-rotating diffuser, together referred to as a "stage." In multistage centrifugal pumps, multiple stages of impeller and diffuser pairs may be used to further increase the pressure lift. The stages are stacked in series around the pump's shaft, with each successive impeller sitting on a diffuser of the previous stage. The pump shaft extends longitudinally through the center of the stacked stages. The shaft rotates, and the impeller is keyed to the shaft causing the impeller to rotate with the shaft.

Conventional ESP assemblies sometimes include bearing sets to carry radial and thrust forces acting on the pump during operation. The bearing set traditionally consists of a sleeve and a bushing. The sleeve is keyed to the shaft and rotates with the shaft. The bushing is pressed or otherwise fitted into the diffuser around the sleeve and should not rotate.

The production fluid passing through the pump often contains solid abrasives, such as sand, rock, rock particles, soils or slurries that can cause damage to the pump components. In order to combat abrasion, the rotatable sleeve and stationary bushing of the bearing set are conventionally made of tungsten carbide composite that includes a binder such as cobalt. The tungsten carbide cobalt composite is a hard, brittle material having a hardness value ranging from 90-100 HRA. The hardened sleeve and bushing is often referred to in the ESP industry as abrasion resistant trim, or "AR trim."

The key that secures the sleeve to the ESP shaft is conventionally a skinny, long rectangular strip about 36 inches in length and made of treated steel or an austenite alloy having a hardness of about 72 HRA (40-60 HRC). The key secures into keyways in the sleeve, the impeller, and the shaft, allowing the sleeve and impeller to rotate with the shaft. Materials with a hardness of 40-60 HRC (72 HRA) are typically used for ESP keys because they are more ductile than harder, more brittle materials and therefore are simple to fabricate and permit the key to withstand shaft twist. Impellers are keyed to the ESP shaft in a similar fashion, with multiple keys stacked along the length of the shaft one above the next.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
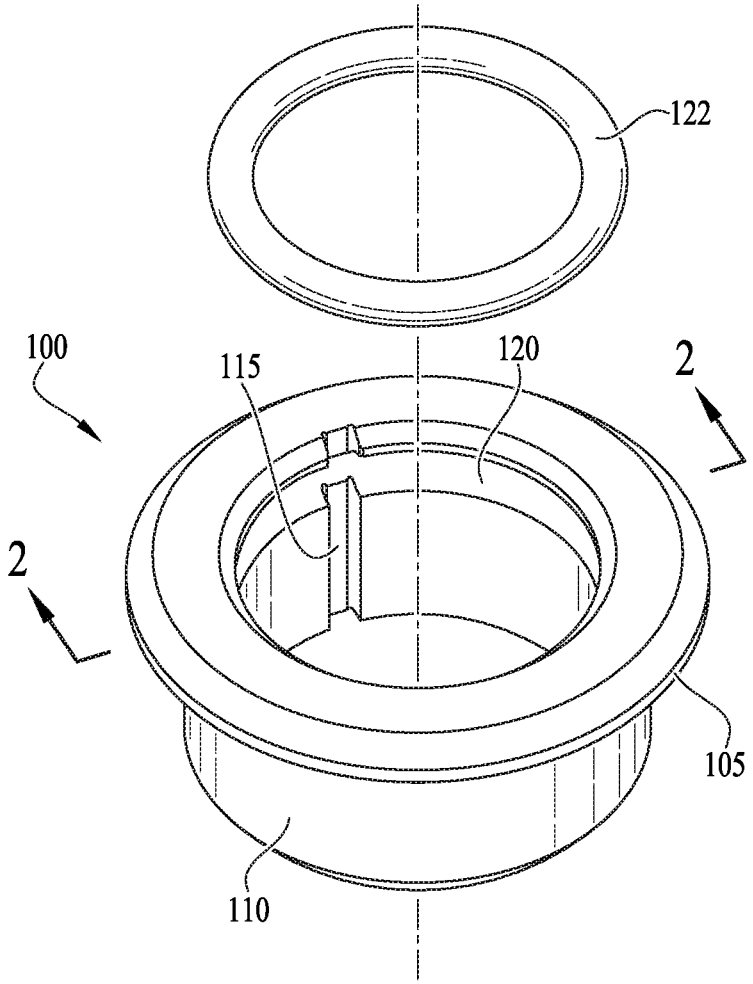
FIG. 1 is a perspective view of a flanged sleeve assembly comprising a flanged sleeve and a seal according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Centrifugal pumps in electric submersible pump (ESP) applications may fail and result in decreased production of oil, gas, or other production fluids from a well. One failure mechanism is failure of coupling of the drive shaft in the centrifugal pump to a flanged sleeve. Flanged sleeves are commonly used in ESPs to transfer down-thrust loads from impellers to diffusers in the centrifugal pump, for example in pumps using a so-called "floating impeller" design. Typically a flanged sleeve is coupled to the drive shaft by a key that is inserted into a keyway in the inside diameter of the flanged sleeve and in the outside diameter of the drive shaft so it rotates with the drive shaft. The flanged sleeve inserts into a bushing fixed in the diffuser. The rotating impeller lower hub transfers down-thrust axial force to the synchronously rotating flanged sleeve, and the flanged sleeve transfers this down-thrust axial force to the bushing and therethrough to the diffuser (the bushing and the diffuser are stationary). The contact surfaces of the flanged sleeve and the bushing are designed and/or manufactured to provide extended service life notwithstanding their rotational sliding engagement. If the keying of the flanged sleeve to the drive shaft fails, however, the flanged sleeve will not rotate synchronously with the lower hub, and the surface of the top of the flanged sleeve and the bottom surface of the lower hub of the impeller above the flanged sleeve will slide relative to each other, and the hub will wear prematurely, leading to early failure of the pump. In a centrifugal pump where a hardened flanged sleeve is used, such as an abrasion resistant (AR) flanged sleeve, the hub may wear even more quickly after a failure of the keying of the flanged sleeve to the drive shaft.

Without intending to be limited by theory, the inventors have discovered that a likely mechanism of failure in ESPs of previous design is erosion of the key at the flanged sleeve caused by fluid flow in the space between the inside diameter of the flanged sleeve and the outside diameter of the drive shaft. This fluid flow is motivated by a pressure differential from a higher pressure at a higher pump stage (uphole) to a lower pressure at a lower pump stage (downhole). The erosion caused by this fluid flow would be expected to be more aggressive where the fluid flow contains abrasive solids such as sand and/or proppants. As hydraulic fracturing has become more prevalent, proppant supplies have depleted and increasingly fine grained proppant has been recruited for use in fracturing jobs. Finer grained proppant (e.g., "sand") material is able to infiltrate the mechanical tolerances between the inside diameter of the flanged sleeve and the outside diameter of the drive shaft and wear the key prematurely. The present disclosure teaches preventing this mechanism of failure by blocking the flow of fluid in this space between the inside diameter of the flanged sleeve and the outside diameter of the drive shaft or, alternatively, diverting the pressure away from an upper lip of the flanged sleeve. By stopping or reducing the fluid flow between the inside diameter of the flanged sleeve and the outside diameter of the drive shaft, erosion of the key can be reduced and key life extended.

Directional terms, such as "up", "below", "downhole", etc. are used in the present disclosure. In general, use of the terms "up", "above", "upper", "uphole", "top", or other like terms refer to a direction toward the surface of the earth along a wellbore; likewise, "down", "lower", "below", "downhole", or other like terms refer to a direction away from the surface of the earth along the wellbore, regardless of the wellbore orientation. For example, in a horizontal wellbore, two locations may be at the same level (i.e., depth within a subterranean formation), the location closer to the well surface (by comparing the lengths along the wellbore from the wellbore surface to the locations) is referred to as "above" the other location.

Figure 2:
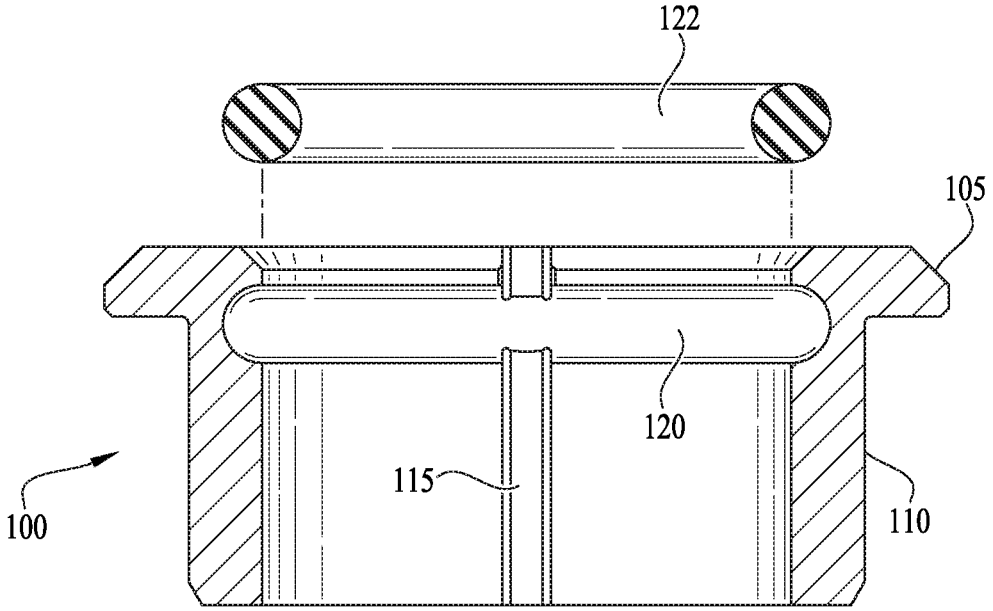
FIG. 2 is a cross-section view of a flanged sleeve and a seal according to the embodiment of FIG. 1 of the disclosure.

Turning now to FIGS. 1 and 2, a first flanged sleeve 100 and a seal 122 are described. The first flanged sleeve 100 comprises a flange 105, a tubular portion 110, and a first keyway 115 for seating of key 145 (shown in FIG. 3). The first flanged sleeve 100 has an inside surface that defines a first circumferential groove 120 (e.g., first circumferential groove 120 disposed within the inside surface of the first flanged sleeve 100 proximate the flange 105). The first flanged sleeve 100 is configured for use in a centrifugal ESP pump, more specifically as a component in a drive shaft of a centrifugal ESP pump. The first flanged sleeve 100, for example the tubular portion 110, may be inserted into a bushing fixed in a diffuser of the pump. The first flanged sleeve 100 may be keyed to a rotatable shaft of the pump, rotate in synchronization with the shaft, and transfer down-thrust axial force from one or more impellers of the pump to the bushing. The first flanged sleeve 100 will be illustrated and described in the context of other parts of the centrifugal ESP pump further hereinafter. The first flanged sleeve 100 may be formed of a variety of different metals. In an embodiment, the first flanged sleeve 100 may be made of abrasion resistant (AR) materials and may be referred to as an AR flanged sleeve in some contexts. The first flanged sleeve 100 may be made of a hard material such as a tungsten carbide composite, tungsten carbide, silicon carbide, titanium carbide, or another similar carbide material. The seal 122 may be disposed in the first groove 120. In an embodiment, the seal 122 may be an O-ring seal, for example comprised of an elastomeric or rubber material. Examples suitable O-ring material include, but are not limited to, one or more material selected from the group consisting of silicone rubber; urethane rubber; natural rubber (polyisoprene); styrene-butadiene-rubber, ethylene propylene diene monomer rubber (EPDM); butyl rubber; polyurethane; NEOPRENE CR® (polychloroprene); hydrogenated nitrile, HYPALON® chlorosulphonated polyethylene; nitrile, VITONQ fluorosilicone; and fluorocarbon.

In an embodiment, the seal 122 may be a lip seal. The lip seal may be disposed primarily in the first groove 120 and may promote ease of traverse movement of the first flanged sleeve 100 over a rotatable shaft 140 (see FIG. 3 below) during assembly of the centrifugal ESP pump. The lip seal may be unsealed in ambient conditions (e.g., at the surface) or when little or no differential pressure is present across the lip seal. When fluid flow and/or differential pressure across the lip seal is present, a lip of the lip seal may deflect towards the rotatable shaft 140, touch the rotatable shaft 140, and make a seal between the first flanged sleeve 100 and the rotatable shaft 140. In embodiments, the lip seal may be comprised of the same type of material disclosed above for the O-ring seals.

Turning now to FIG. 2, the first flanged sleeve 100 is shown in cross-section. The first groove 120 is configured to receive the first seal 122 before installation of the first flanged sleeve 100 over a rotatable shaft or drive shaft of the centrifugal ESP pump.

Figure 3:
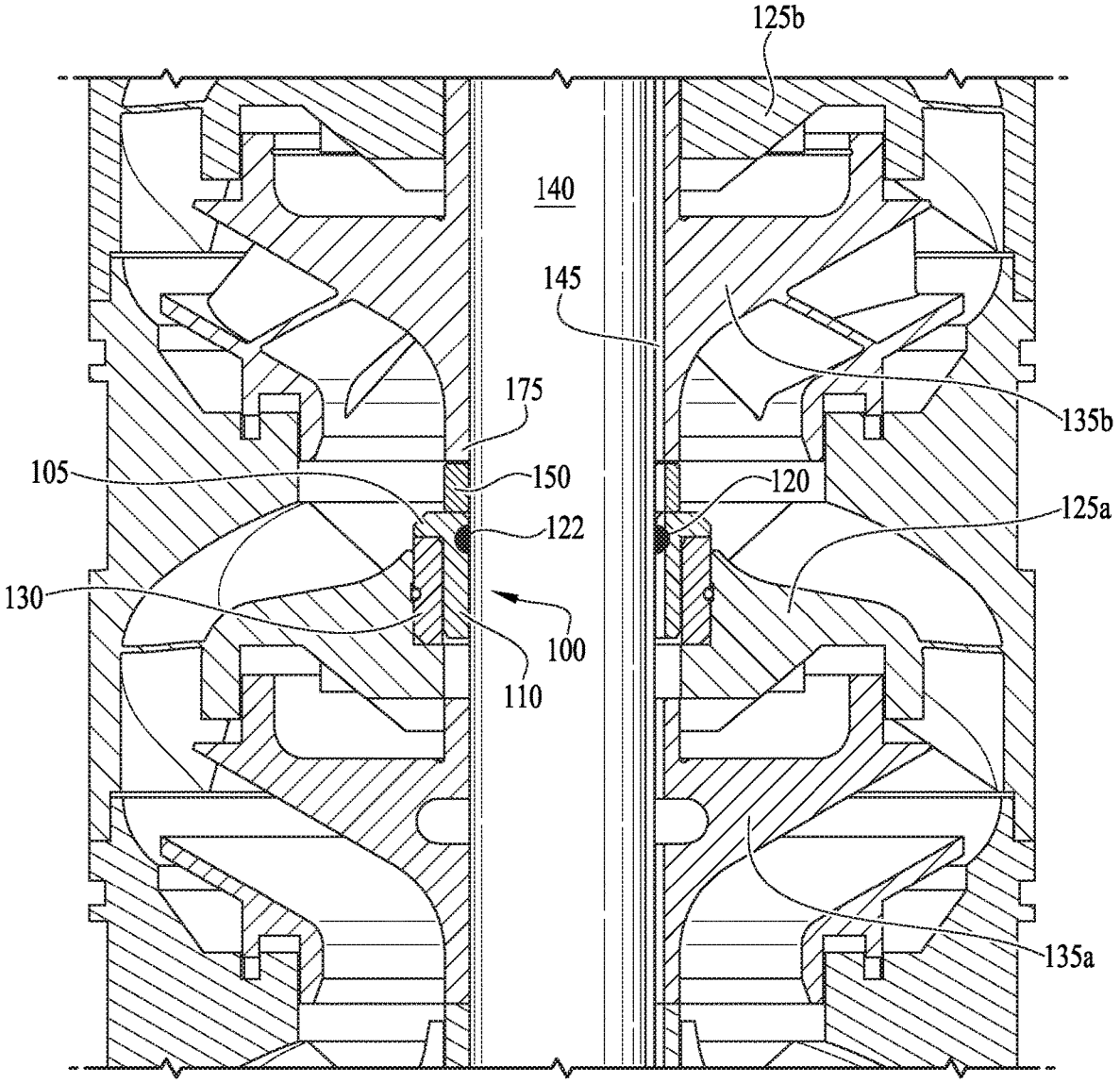
FIG. 3 is a cross-section view of a flanged sleeve seated in a bushing in a stack of impellers and diffusers of a centrifugal pump and a seal disposed between the flanged sleeve and a rotatable shaft according to the embodiment of FIGS. 1 and 2 of the disclosure.

Turning now to FIG. 3, the first flanged sleeve 100 and first seal 122 are illustrated in the context of a centrifugal ESP pump. The first flanged sleeve 100 and first seal 122 are shown in position mounted onto the rotatable shaft 140. The first flanged sleeve 100, for example tubular portion 110, is inserted into a bushing 130 that is secured by a first diffuser 125*a*. A first impeller 135*a* is shown in position below (i.e., downhole of) the first diffuser 125*a*. A cylindrical standoff sleeve 150 is positioned above (i.e., uphole of) the first flanged sleeve 100, and a second impeller 135*b* is positioned above the standoff sleeve 150. A second diffuser 125*b* is positioned above (i.e., uphole of) the second impeller 135*b*. The first flanged sleeve 100, the first impeller 135*a*, and the second impeller 135*b* are each keyed to the rotatable shaft 140 by a key 145 that is positioned between a keyway of the rotatable shaft 140 and in keyways in each of the first flanged sleeve 100, the first impeller 135*a*, and the second impeller 135*b*. A lower hub 175 of the second impeller 135*b* is illustrated supported axially (e.g., in a direction parallel with a central axis of the rotatable shaft 140) by the standoff sleeve 150, and the standoff sleeve 150 is supported axially by the first flanged sleeve 100.

In operation, the rotatable shaft 140 is turned by an electric submersible motor 800 (shown in FIG. 10), and the rotatable shaft 140 turns the first flanged sleeve 100, the first impeller 135*a*, and the second impeller 135*b*. The first diffuser 125*a* and the second diffuser 125*b* are statically positioned and do not rotate. As the first impeller 135*a* turns, fluid flows uphole in the centrifugal ESP pump, into an intake of the first impeller 135*a*, and is accelerated by the first impeller 135*a*. The first diffuser 125*a* converts the kinetic energy of the fluid to pressure. Hence, there may be a pressure differential between the top (i.e., uphole end proximate the flange 105) of the first flanged sleeve 100 and the bottom (i.e., downhole end proximate the lower end of tubular portion 110 and distal the uphole end proximate the flange 105) of the first flanged sleeve 100. The first seal 122 blocks or partially blocks the fluid pumped by the first impeller 135*a* from flowing between the inside diameter of the first flanged sleeve 100 (e.g., the inner surface of the tubular portion 110) and the outside diameter of the rotatable shaft 140 in response to the pressure differential, thereby stopping or reducing fluid flow that otherwise might cause the key 145 to fail at the first flanged sleeve 100.

In an embodiment, the first flanged sleeve 100 may have another circumferential groove defined by its interior surface, downhole of the first groove 120, and a second seal may be positioned in this other groove and mounted on the rotatable shaft 140, thereby providing redundant or back-up seals between the first flanged sleeve 100 and the rotatable shaft 140. In an embodiment, the impellers 135*a*, 135*b* may each have a circumferential groove defined by their interior surfaces at their tops and/or at their bottoms, and seals may be positioned in these grooves and mounted on the rotatable shaft 140.

Figure 4A:
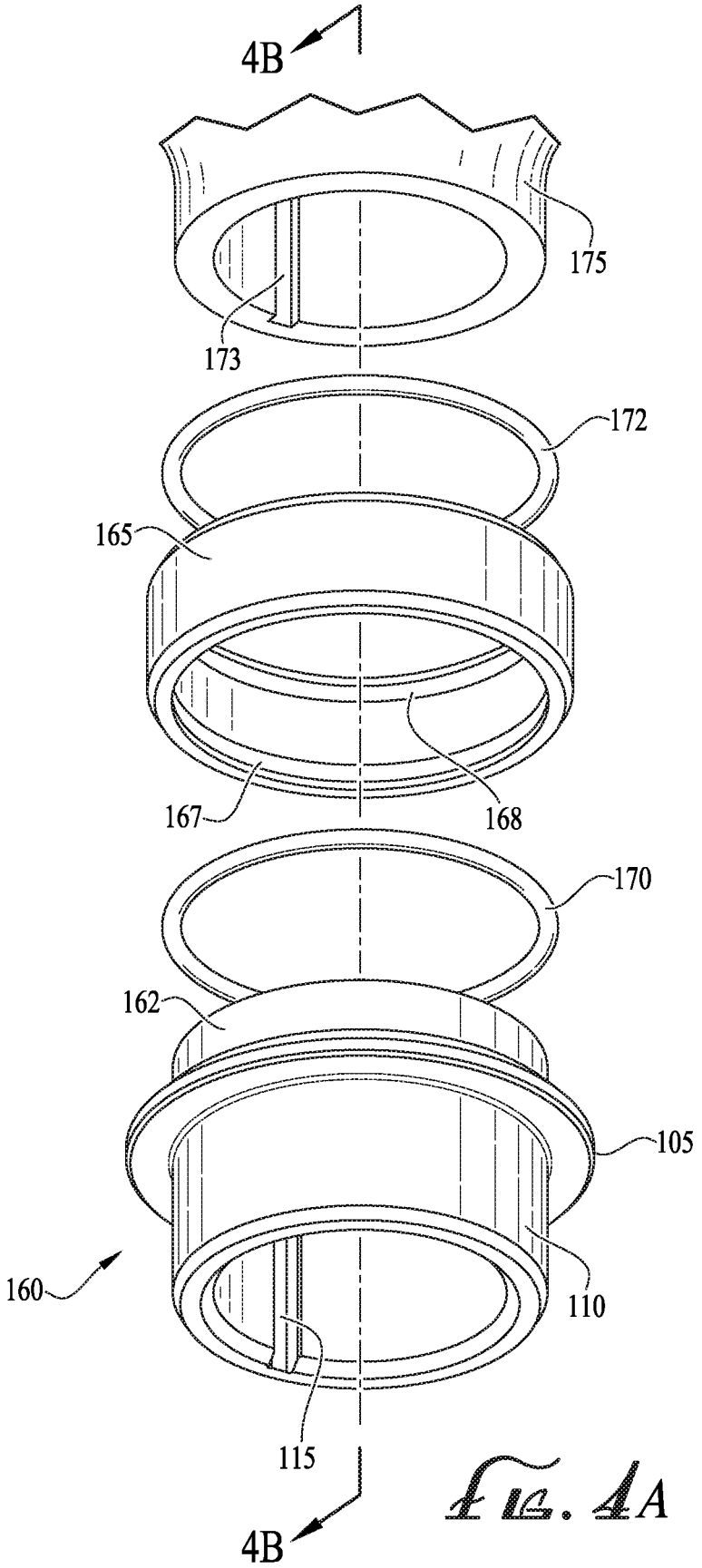
FIG. 4A is a perspective view of a flanged sleeve assembly comprising a flanged sleeve, a seal sleeve, two seals, and a lower hub of an impeller according to an embodiment of the disclosure.
Figure 4B:
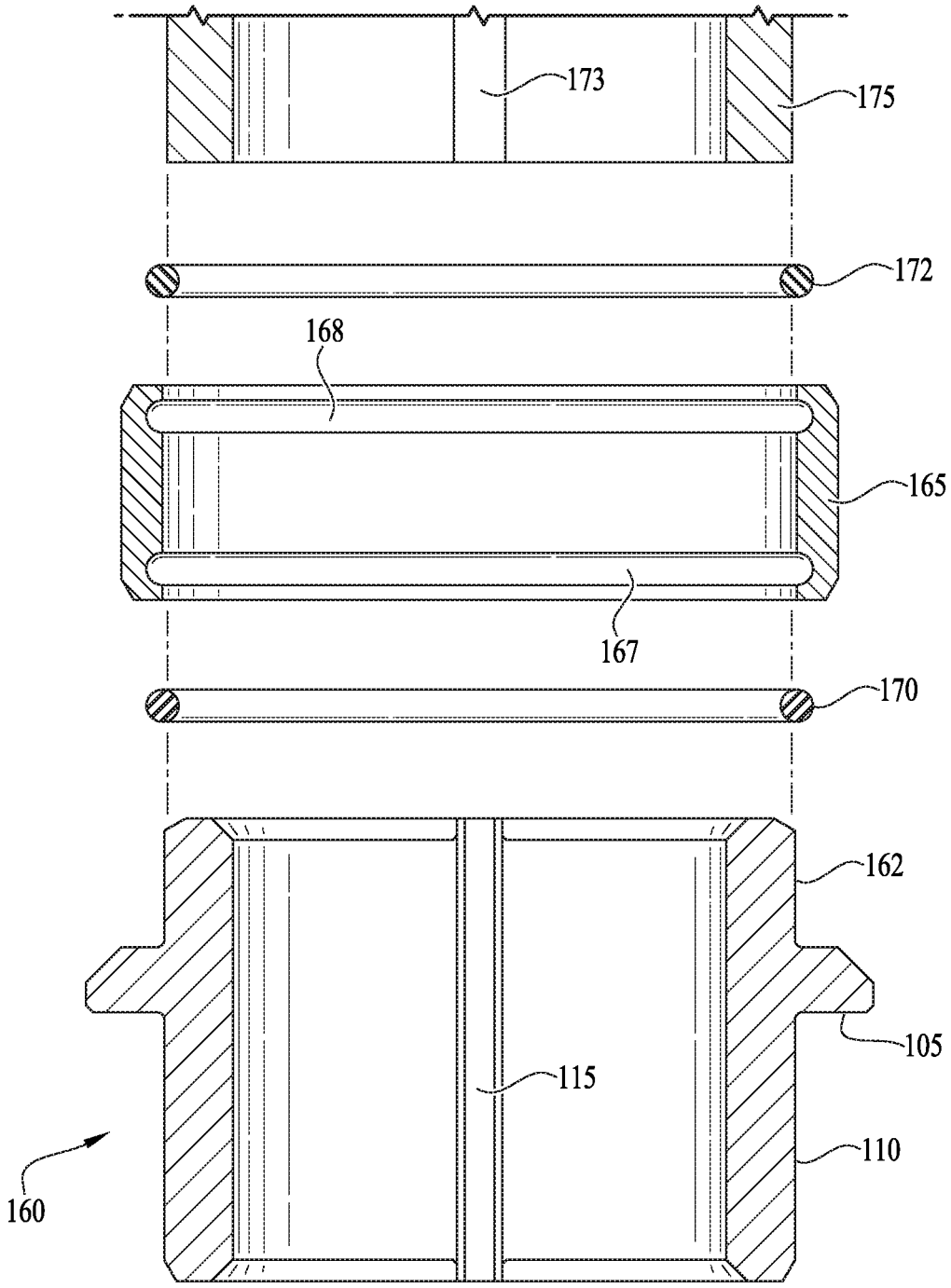
FIG. 4B is a cross-section view of a flanged sleeve, a seal sleeve, and two seals according to the embodiment of FIG. 4A of the disclosure.

Turning now to FIG. 4A and FIG. 4B, a second flanged sleeve 160 is described. The second flanged sleeve 160 comprises the flange 105, the tubular portion 110, the first keyway 115, and an integrated standoff portion 162, wherein the tubular portion 110 extends downward from flange 105 and the integrated standoff portion 162 extends upward from the flange 105. Also shown in FIG. 4A and FIG. 4B are a seal sleeve 165 having an interior surface that defines a second circumferential groove 167 and a third circumferential groove 168 (e.g., second and third circumferential grooves 167,168 disposed within the inside surface of the seal sleeve 165 proximate opposite ends thereof), a second seal 170, and a third seal 172. In embodiments, the seals 170, 172 may be O-ring seals of the type disclosed herein. In embodiments, the seals 170, 172 may be lip seals. The grooves 167 and 168 are configured to receive the second seal 170 and the third seal 172, respectively, before installation over the rotatable shaft 140. Also shown in FIGS. 4A and 4B are the lower hub 175 of the impeller 135 and a second keyway 173 of the impeller 135. In embodiments, the second flanged sleeve 160 may be formed of a variety of different metals. In an embodiment, the second flanged sleeve 160 may be made of abrasion resistant (AR) materials and may be referred to as an AR flanged sleeve in some contexts. The second flanged sleeve 160 may be made of a hard material such as a tungsten carbide composite, tungsten carbide, silicon carbide, titanium carbide, or another similar carbide material. The seal sleeve 165 may be formed of a variety of different metals, for example the same as or different than the second flanged sleeve 160.

Figure 5:
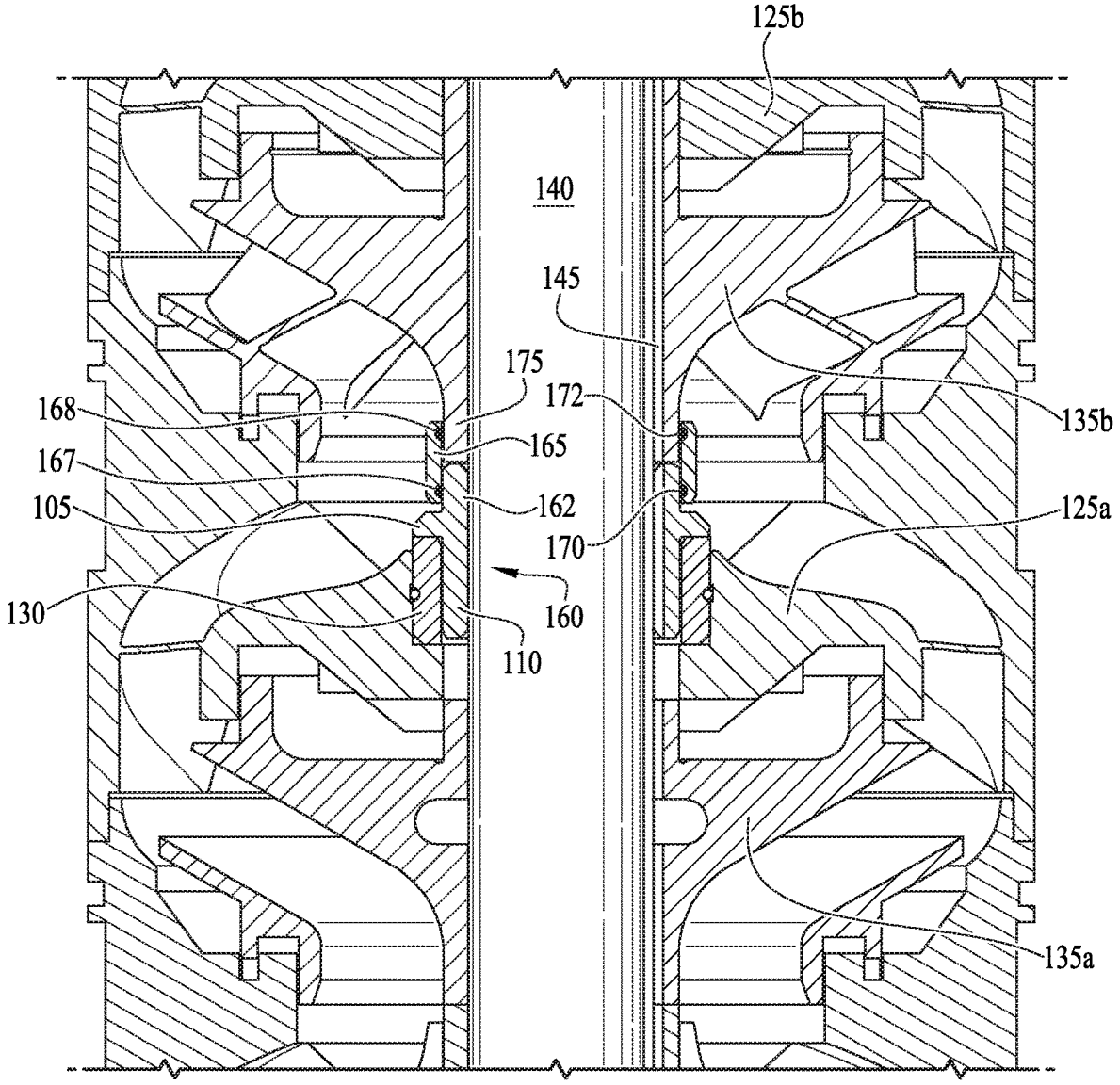
FIG. 5 is a cross-section view of a flanged sleeve seated in a bushing in a stack of impellers and diffusers of a centrifugal pump, a seal sleeve, and two seals disposed between the flanged sleeve and a lower hub of an impeller according to the embodiment of FIGS. 4A and 4B of the disclosure.

Turning now to FIG. 5, the second flanged sleeve 160, the seal sleeve 165, the second seal 170, and the third seal 172 are illustrated in the context of a centrifugal ESP pump. The second flanged sleeve 160 is shown in position mounted onto the rotatable shaft 140 and inserted into the bushing 130 secured by the first diffuser 125*a*. The seal sleeve 165, the second seal 170, and the third seal 172 are shown in position mounted onto the rotatable shaft 140, the lower end of the seal sleeve 165 and the second seal 170 positioned over the integrated standoff portion 162 of the second flanged sleeve 160, and the upper end of the seal sleeve 165 and the third seal 172 positioned over the lower end of the lower hub 175 of the second impeller 135*b*.

In operation, as described above with reference to FIG. 3, a pressure differential may develop between the top of the second flanged sleeve 160 (proximate the upper end of the integrated standoff portion 162) and the bottom of the second flanged sleeve 160 (proximate the lower end of the tubular portion 110 and distal the upper end of the integrated standoff portion 162). The seal sleeve 165, the second seal 170, and the third seal 172 block or partially block the fluid pumped by the first impeller 135*a* from flowing between the inside diameter of the second flanged sleeve 160 and the outside diameter of the rotatable shaft 140 in response to the pressure differential, thereby stopping or reducing fluid flow that otherwise might cause the key 145 to fail at the second flanged sleeve 160. The seal sleeve 165 and the third seal 172 also block or partially block the fluid flow between the interior of the second impeller 135*b* and the rotatable shaft 140.

Figure 6A:
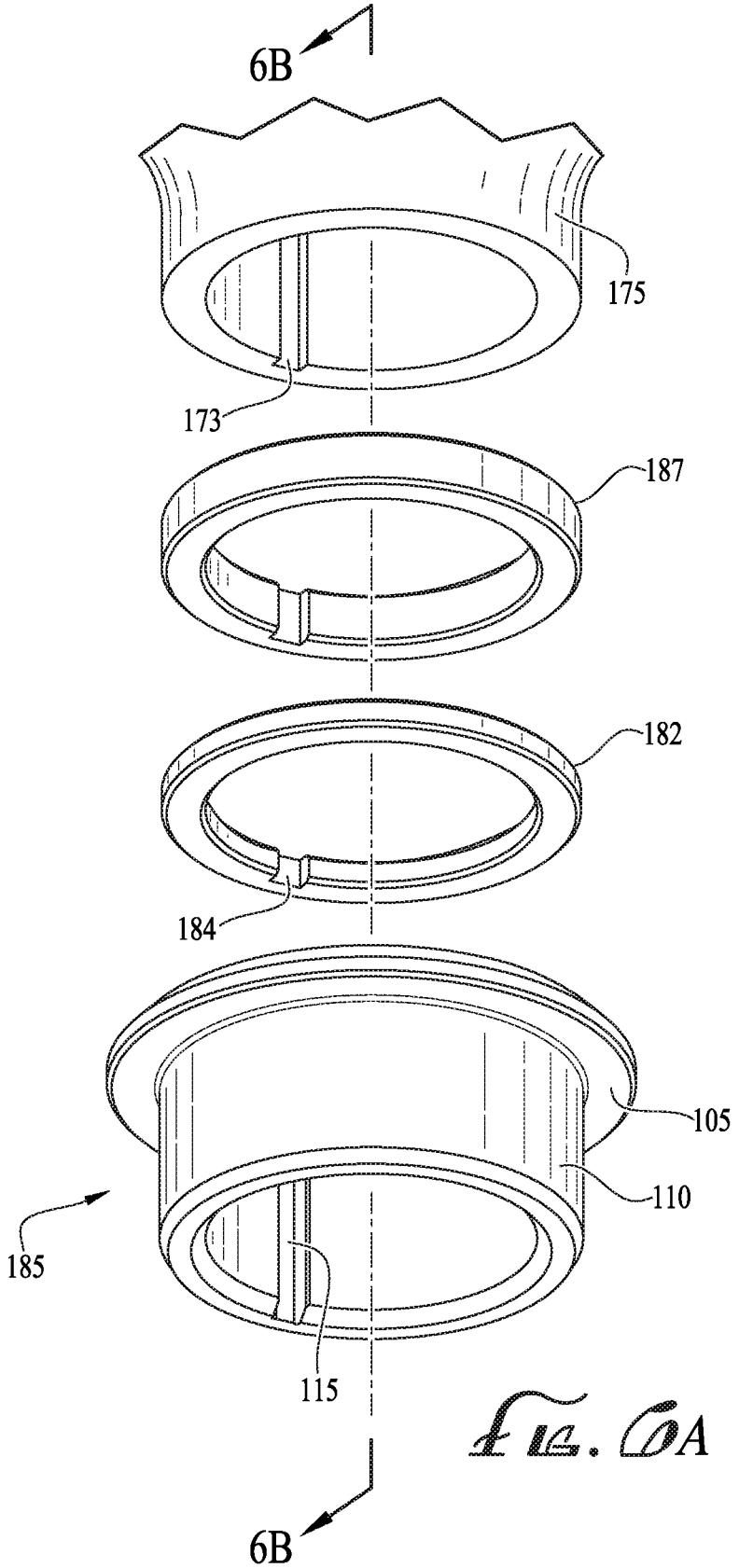
FIG. 6A is a perspective view of a flanged sleeve assembly comprising a flanged sleeve, a gasket, a standoff, and a lower hub of an impeller of a centrifugal pump according to an embodiment of the disclosure.
Figure 6B:
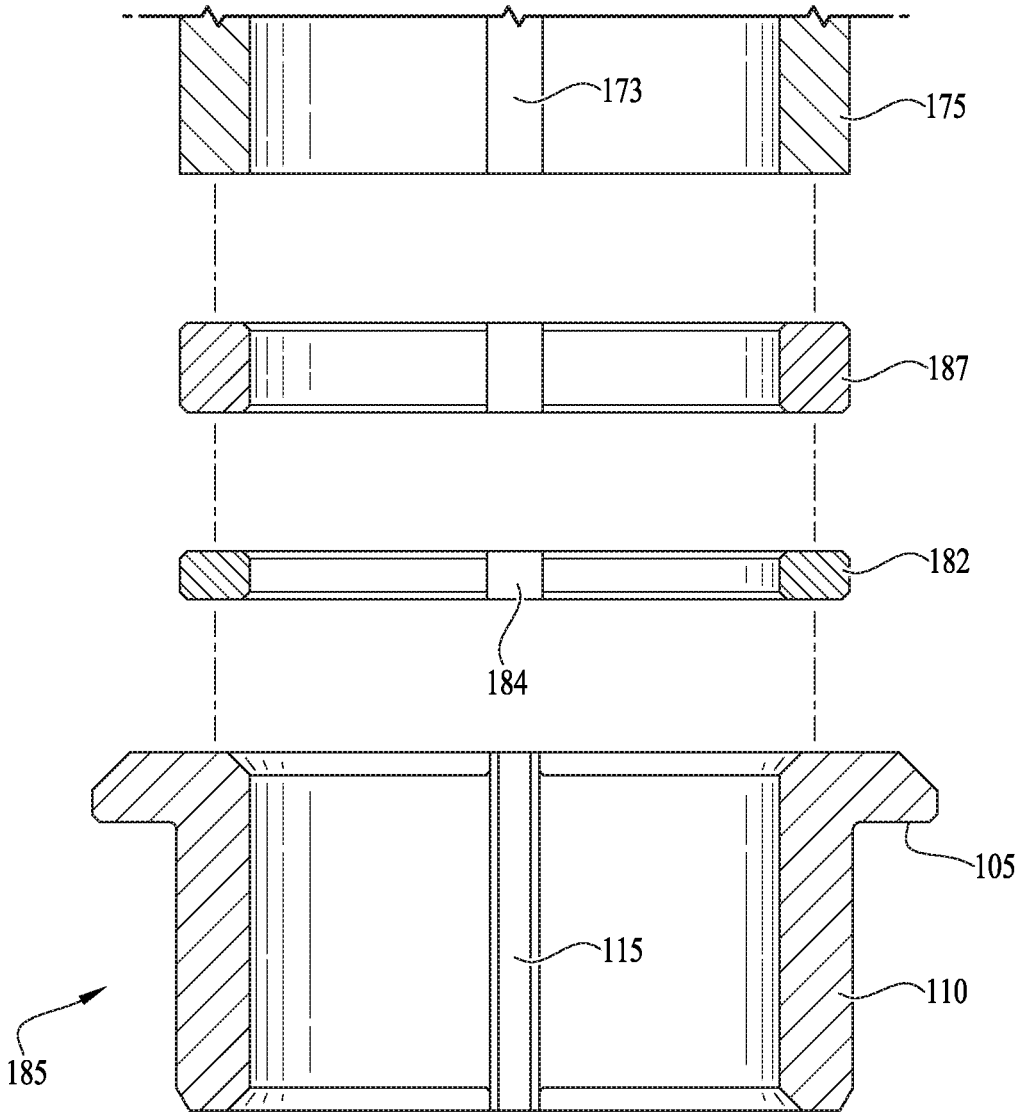
FIG. 6B is a cross-section view of a flanged sleeve, a gasket, a standoff, and a lower hub of an impeller of a centrifugal pump according to the embodiment of FIG. 6A the disclosure.

Turning now to FIG. 6A and FIG. 6B, a gasket seal 182 and a third flanged sleeve 185 are described. The gasket seal 182 defines a notch 184 (e.g., notch 184 is disposed within the inside surface of the gasket seal 182, providing a keyway for receipt of key 145). In an aspect, the gasket seal 182 is a thin, cylindrical or "pancake" seal having a central opening for receipt of rotatable shaft 140. In embodiments, the gasket seal 182 may be comprised of the same type of material disclosed herein for the O-ring seals and/or the lip seals. Examples of suitable gasket material for the gasket seal 182 include, but are not limited to, one or more material selected from the group consisting of RULON® polytetrafluoroethylene (PTFE) plastic commercially available from Saint-Gobain Performance Plastics and VITON® fluoroelastomer commercially available from Chemours. In an embodiment, the gasket seal 182 may be comprised of elastomeric material.

The third flanged sleeve 185 is substantially similar to the first flanged sleeve 100, with the distinction that the inside surface of the third flanged sleeve 185 does not define a circumferential groove (e.g., circumferential groove 120) as does the first flanged sleeve 100. The gasket seal 182 is shown between a cylindrical standoff 187 (also referred to as a cylindrical standoff sleeve or more simply, a standoff) and the lower hub 175 of the second impeller 135*b*. The notch 184 of the gasket seal 182 may be aligned with the first keyway 115 of the third flanged sleeve 185 and with the second keyway 173 of the second impeller 135*b*. In embodiments, the third flanged sleeve 185 may be formed of a variety of different metals. In an embodiment, the third flanged sleeve 185 may be made of abrasion resistant (AR) materials and may be referred to as an AR flanged sleeve in some contexts. The third flanged sleeve 185 may be made of a hard material such as a tungsten carbide composite, tungsten carbide, silicon carbide, titanium carbide, or another similar carbide material.

Figure 7:
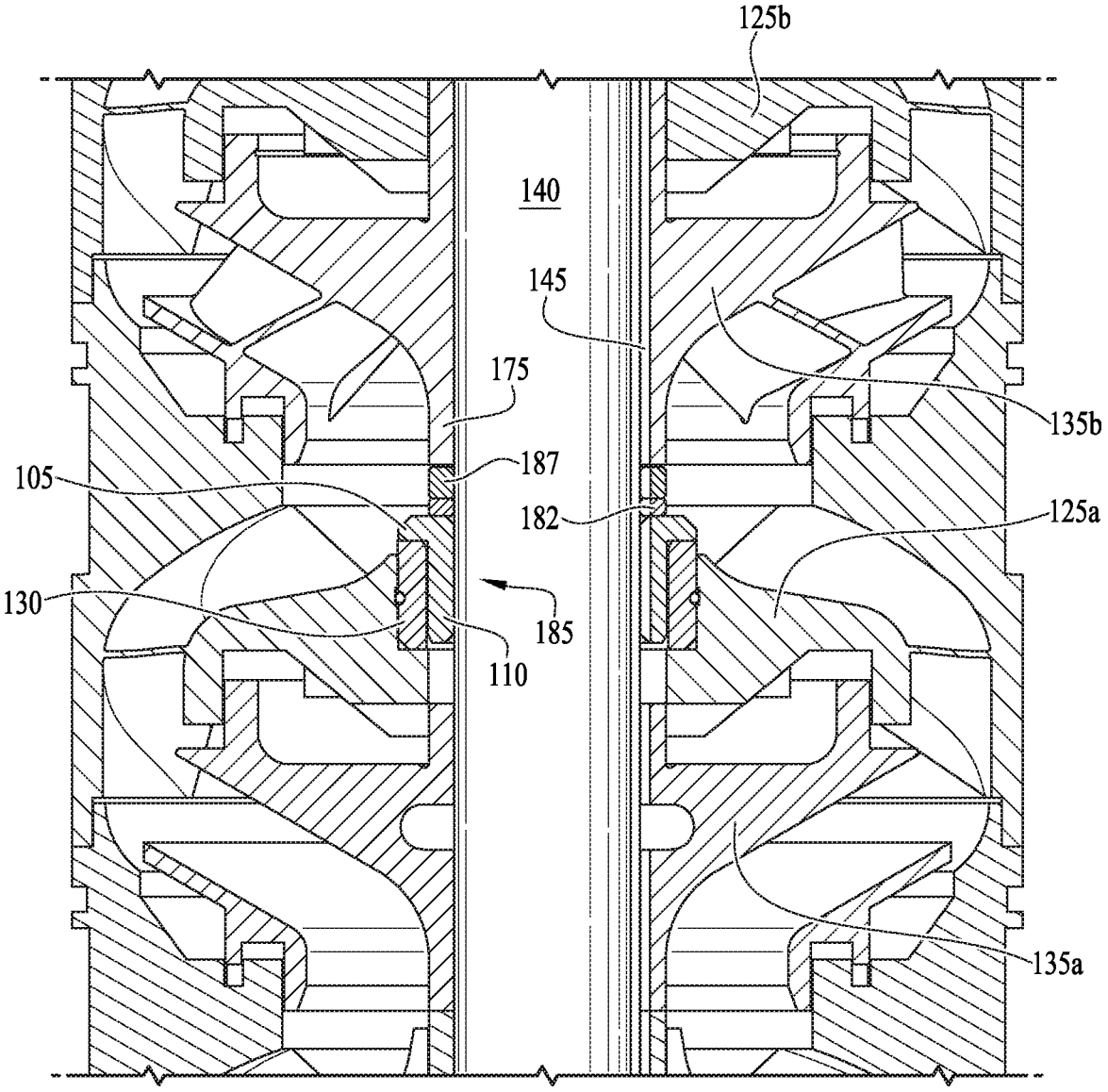
FIG. 7 is a cross-section view of a flanged sleeve seated in a bushing in a stack of impellers and diffusers of a centrifugal pump, a gasket, and a standoff according to the embodiment of FIGS. 6A and 6B of the disclosure.

Turning now to FIG. 7, the third flanged sleeve 185, the gasket seal 182, and the standoff 187 are illustrated in the context of a centrifugal ESP pump. The third flanged sleeve 185, the gasket seal 182, and the standoff 187 are shown in position mounted onto the rotatable shaft 140 between the lower hub 175 of the second impeller 135*b* and the first diffuser 125*a*. The tubular portion 110 of third flanged sleeve 185 is shown inserted into the bushing 130 secured by (i.e., non-rotatably or statically coupled to) the first diffuser 125*a*.

In operation, as described above with reference to FIG. 3, a pressure differential may develop between the top (i.e., uphole end proximate the flange 105) of the third flanged sleeve 185 and the bottom (i.e., downhole end proximate the lower end of tubular portion 110 and distal the uphole end proximate the flange 105) of the third flanged sleeve 185. In operation, the lower hub 175 of the second impeller 135*b* applies down-thrust axial force on the standoff 187. The standoff 187 transfers this down-thrust axial force onto the gasket seal 182, pressing the gasket seal 182 against the third flanged sleeve 185 (e.g., an upper sealing surface on the top surface of flange 105). In embodiments, the gasket seal 182 may partially deform under the stress of the down-thrust axial force and blocks or partially blocks fluid flow between the inside diameter of the third flanged sleeve 185 (e.g., the inner surface of the tubular portion 110) and the outside diameter of the rotatable shaft 140 in response to the pressure differential, thereby stopping or reducing fluid flow that otherwise might cause the key 145 to fail at the third flanged sleeve 185.

Figure 8A:
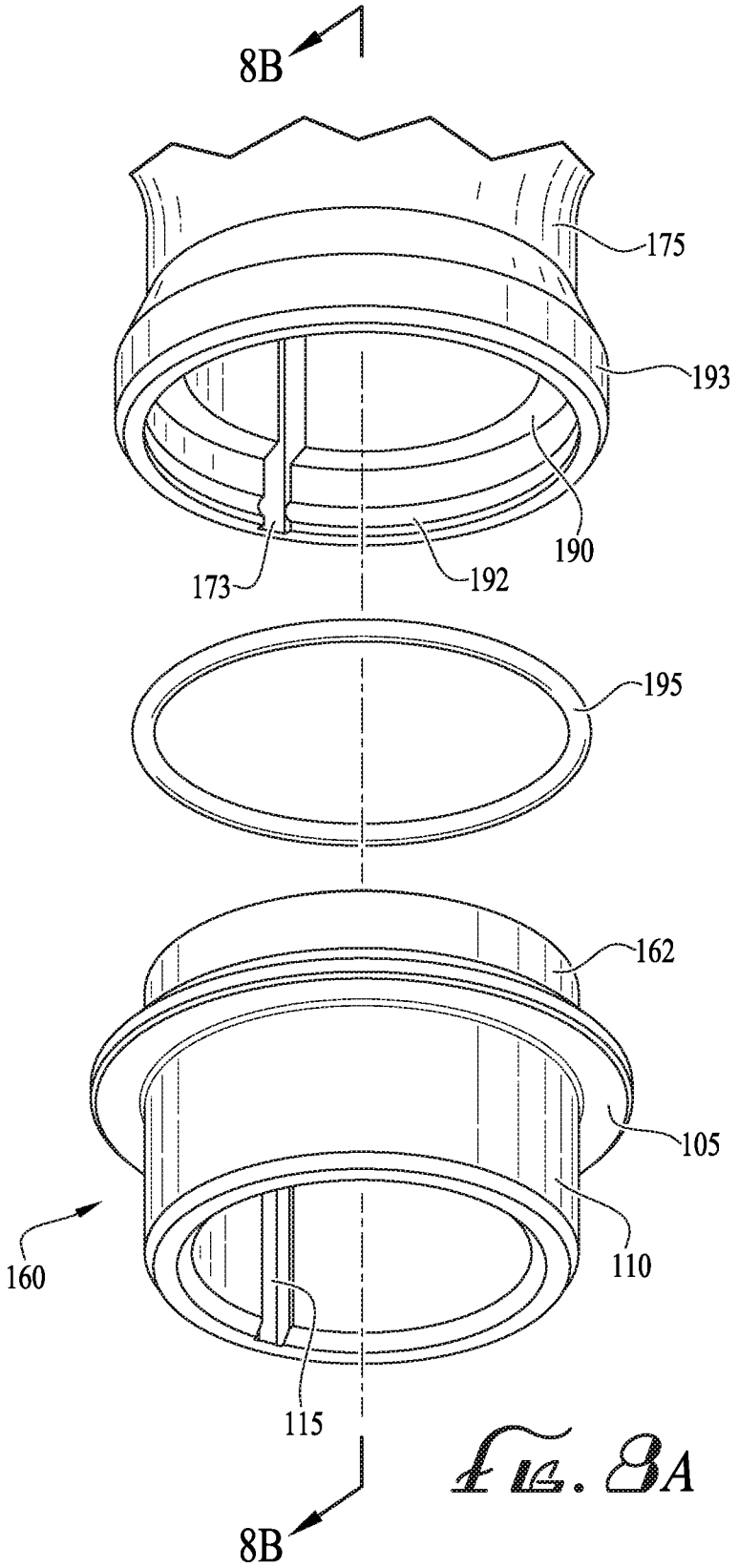
FIG. 8A is a perspective view of a flanged sleeve assembly comprising a flanged sleeve, a seal, and a receptacle of a lower hub of an impeller of a centrifugal pump according to an embodiment of the disclosure.
Figure 8B:
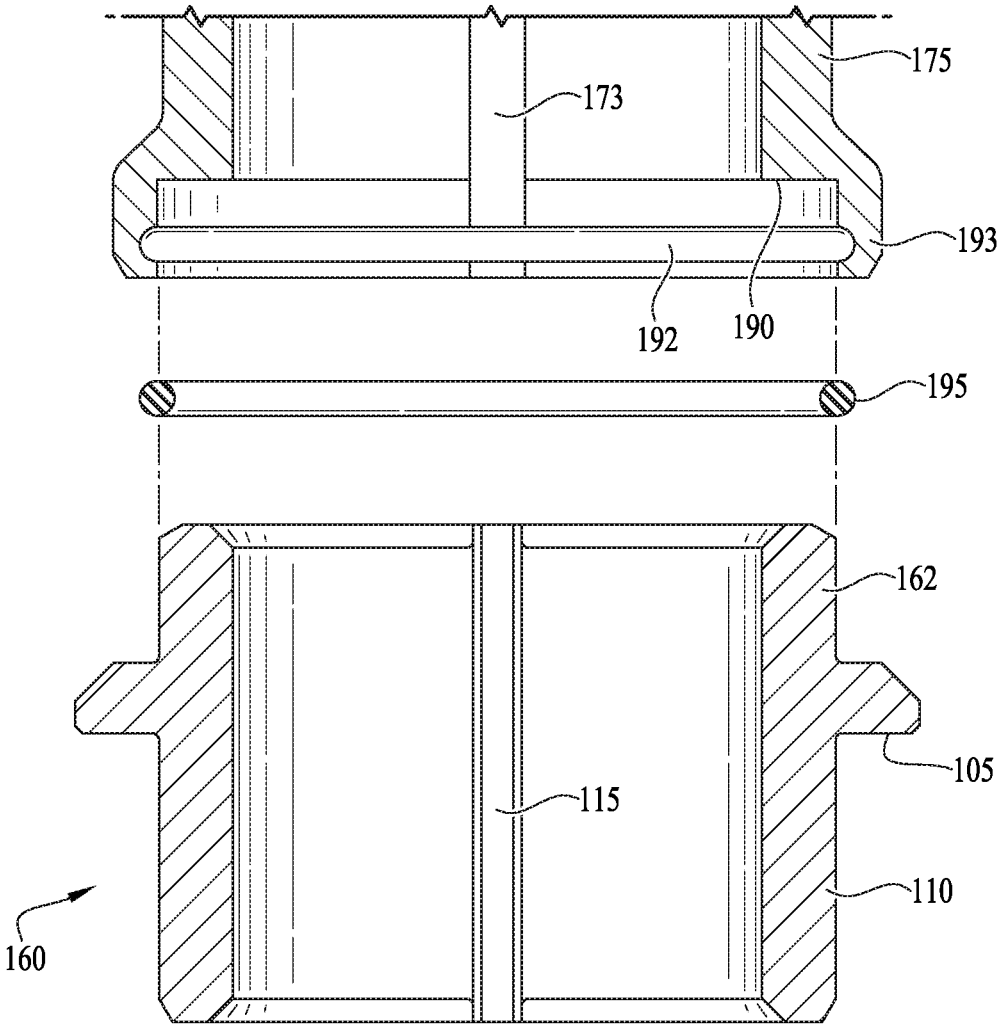
FIG. 8B is a cross-section view of a flanged sleeve, a seal, and a receptacle of a lower hub of an impeller of a centrifugal pump according to the embodiment of FIG. 8A of the disclosure.

Turning now to FIG. 8A and FIG. 8B, the second flanged sleeve 160, the lower hub 175, and a fourth seal 195 are described. The second flanged sleeve 160 is similar to second flanged sleeve 160 described in reference to FIGS. 4A and 4B. In an embodiment, an interior surface of the lower hub 175 defines a seat 190, a fourth circumferential groove 192 (e.g., fourth circumferential groove 192 disposed within the inside surface of a bell 193 proximate an end thereof), and the bell 193. In some contexts, the bell 193 may be referred to as a bell receptacle or a bell-shaped receptacle. In some contexts, the bell 193 may be referred to as a receptacle. In an embodiment, the fourth seal 195 is retained by the fourth groove 192. When the centrifugal ESP pump is assembled and the impeller is mounted on the rotatable shaft 140, the bell 193 of the lower hub 175 of the impeller 135 receives the standoff portion 162 of the flanged sleeve, down-thrust axial force of the impeller 135 is transferred by the seat 190 to the second flanged sleeve 160, and the fourth seal 195 blocks a flow path between the outside of the lower hub 175 and the inside diameter of the second flanged sleeve 160.

Figure 9:
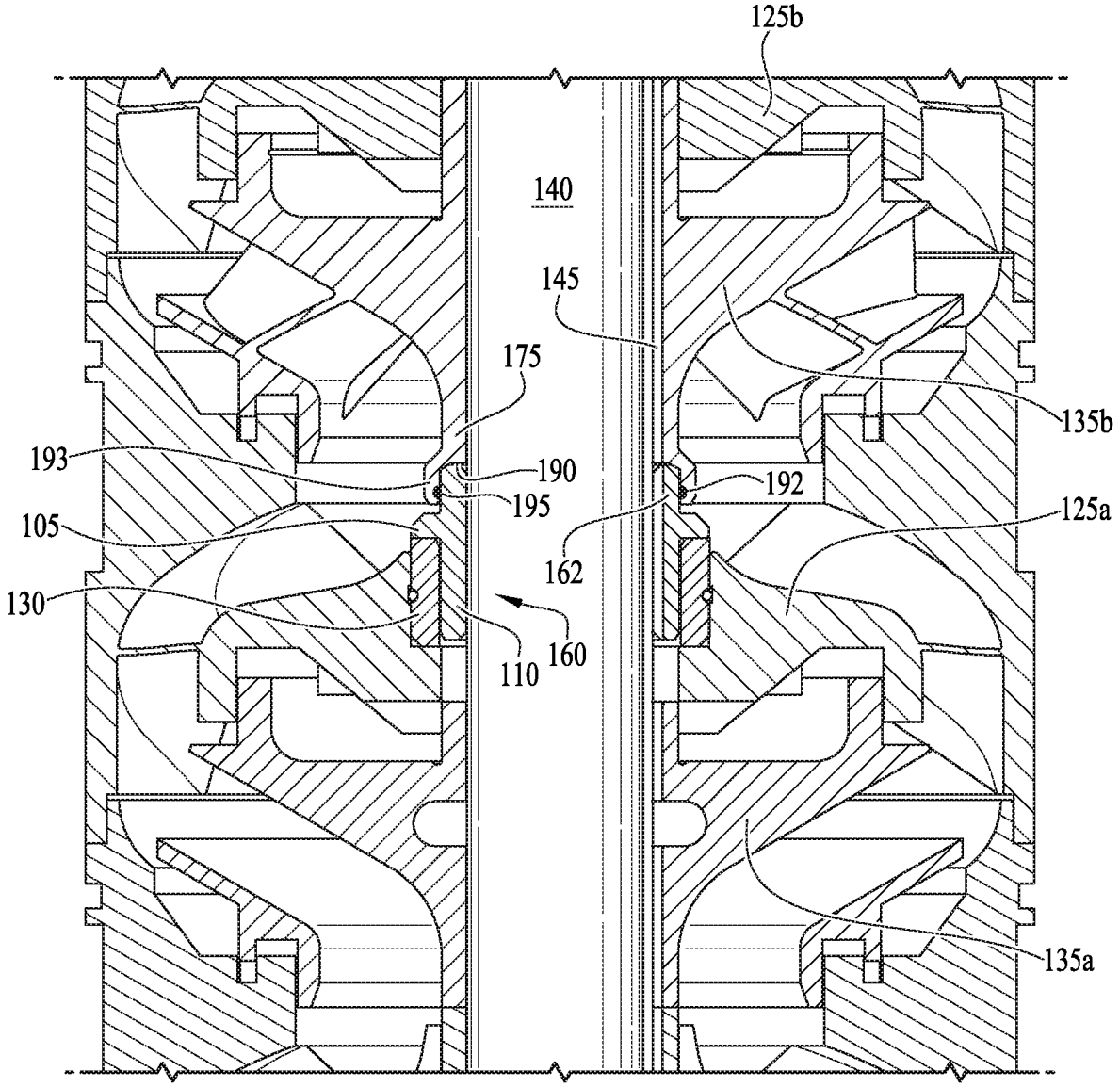
FIG. 9 is a cross-section view of a flanged sleeve seated in a bushing and received into a receptacle of a lower hub of an impeller of a centrifugal pump with a seal disposed between the flanged sleeve and the lower hub of the impeller in a stack of impellers and diffusers of the centrifugal pump according to the embodiment of FIGS. 8A and 8B the disclosure

Turning now to FIG. 9, the second flanged sleeve 160, the lower hub 175, the seat 190, the bell 193, and the fourth seal 195 are illustrated in the context of a centrifugal ESP pump. The second flanged sleeve 160, the lower hub 175, and the fourth seal 195 are shown in position mounted onto the rotatable shaft 140. The tubular portion 110 of the second flanged sleeve 160 is shown inserted into the bushing 130 secured by (i.e., non-rotatably or statically coupled to) the first diffuser 125*a*. The standoff portion 162 of the second flanged sleeve 160 is shown contacting the seat 190. The bell 193 is shown receiving the standoff portion 162. In some contexts, the standoff portion 162 of the second flanged sleeve 160 may be said to be inserted/installed into and/or received within the bell 193. The fourth seal 195 is shown between the inside surface of the bell 193 of the lower hub 175 and the outside surface of the standoff portion 162 of the second flanged sleeve 160.

In operation, as described above with reference to FIG. 3, a pressure differential may develop between the top of the second flanged sleeve 160 (proximate the upper end of the integrated standoff portion 162) and the bottom of the second flanged sleeve 160 (proximate the lower end of the tubular portion 110 and distal the upper end of the integrated standoff portion 162). The fourth seal 195 in the fourth groove 192 in the bell 193 of the lower hub 175 blocks or partially blocks the fluid pumped by the first impeller 135*a* from flowing between the inside diameter of the first flanged sleeve 100 and the outside diameter of the rotatable shaft 140 in response to the pressure differential, thereby stopping or reducing fluid flow that otherwise might cause the key 145 to fail at the second flanged sleeve 160. The seal 192 also blocks or partially blocks the fluid flow between the interior of the second impeller 135*b* and the rotatable shaft 140.

Figure 10:
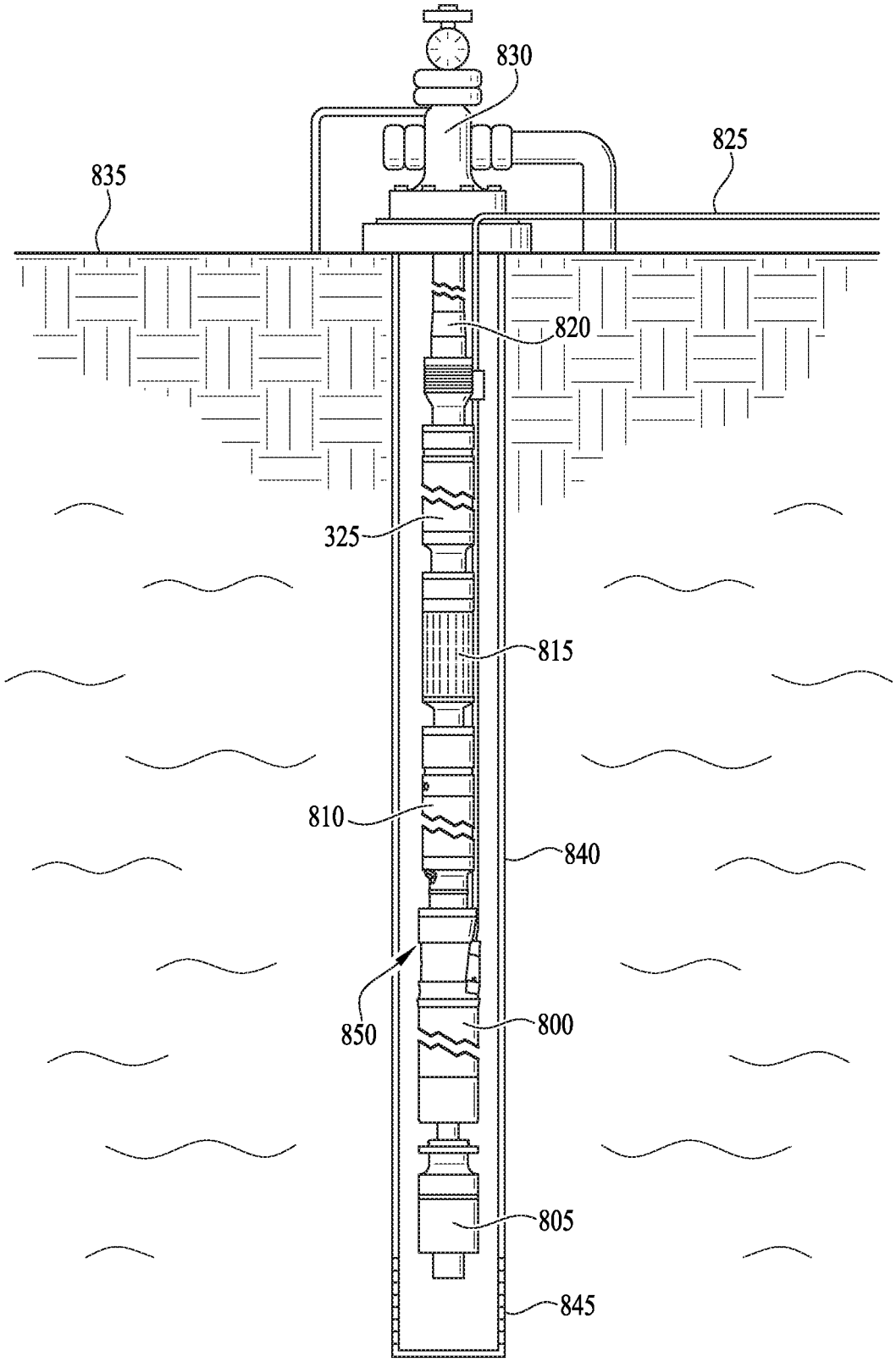
FIG. 10 is an illustration of an electric submersible pump (ESP) assembly according to an embodiment of the disclosure.

FIG. 10 illustrates an exemplary electric submersible pump (ESP) assembly that may employ a flanged sleeve assembly of illustrative embodiments, for example as discussed above with reference to FIGS. 1 to 9 and the related text. Multistage centrifugal pump 325 may be situated in a downhole well, such as an oil or natural gas well. Fluid may enter casing 840 through perforations 845 in the casing. Downhole well and/or ESP assembly 850 may be vertical, horizontal or operate within a bend or radius. Electric submersible motor 800 may operate to turn a drive shaft (e.g., rotatable shaft 140) of centrifugal pump 325 and may be a two-pole, three phase squirrel cage induction motor. Power cable 825 may provide power to motor 800 from a power source located at surface 835 of the well. In gaseous wells, a gas separator and/or a tandem charge pump may be included in ESP assembly 850. Gas separator and/or intake section 815 may serve as the intake for fluid into centrifugal pump 325. Seal section 810 may equalize pressure in motor 800 and keep well fluid from entering motor 800. Production tubing 820 may carry lifted fluid to wellhead 830 and/or surface 835 of the well. Downhole sensors 805 may be mounted internally or externally to ESP assembly 850, below, above, and/or proximate motor 800.

Figure 11:
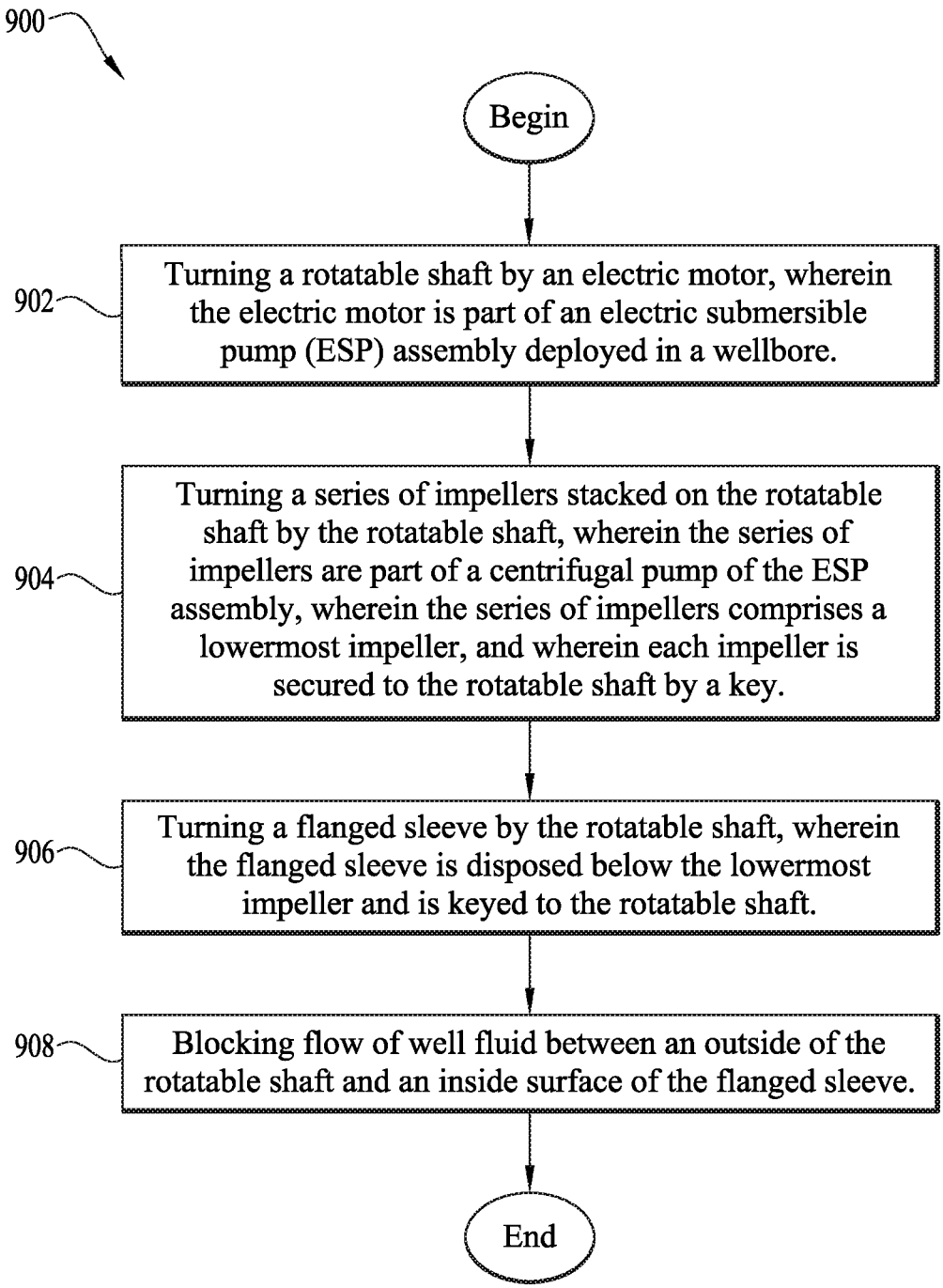
FIG. 11 is a flow chart of a method of lifting well fluids according to an embodiment of the disclosure.

Turning now to FIG. 11, a method 900 is described. In an embodiment, the method 900 is a method of lifting well fluids. At block 902, the method 900 comprises turning a rotatable shaft by an electric motor, wherein the electric motor is part of an electric submersible pump (ESP) assembly deployed in a wellbore. At block 904, the method 900 comprises turning a series of impellers stacked on the rotatable shaft by the rotatable shaft, wherein the series of impellers are part of a centrifugal pump of the ESP assembly, wherein the series of impellers comprises a lowermost impeller, and wherein each impeller is secured to the rotatable shaft by a key. At block 906, the method 900 comprises turning a flanged sleeve by the rotatable shaft, wherein the flanged sleeve is disposed below the lowermost impeller and is keyed to the rotatable shaft.

At block 908, the method 900 comprises blocking flow of well fluid between an outside of the rotatable shaft and an inside surface of the flanged sleeve. In an embodiment, the well fluid may be blocked by the first seal 122 positioned in the first circumferential groove 120 of the first flanged sleeve 100 mounted on the rotatable shaft 140, for example as shown with reference to FIGS. 1 to 3 and related text. In an embodiment, the well fluid may be blocked by the second seal 170 positioned in the second circumferential groove 167 of the seal sleeve 165 and/or by the third seal 172 positioned in the third circumferential groove 168 of the seal sleeve 165 mounted on the rotatable shaft 140, where the seal sleeve 165 and second seal 170 engage the standoff portion 162 of the second flanged sleeve 160 and the seal sleeve 165 and the third seal 172 engage the lower hub 175 of the impeller, for example as shown with reference to FIGS. 4A, 4B, and 5 and related text. In an embodiment, the well fluid may be blocked by the seal gasket 182 mounted on the rotatable shaft 140 between the third flanged sleeve 185 and the standoff 187 also mounted on the rotatable shaft 140, for example as shown with reference to FIGS. 6A, 6B, and 7 and related text. In an embodiment, the well fluid may be blocked by the fourth seal 195 positioned in the fourth circumferential groove 192 of the lower hub 175 of the impeller 135 mounted on the rotatable shaft 140, where the fourth seal 195 engages the standoff portion 162 of the second flanged sleeve 160 also mounted on the rotatable shaft 140, for example as shown with reference to FIGS. 8A, 8B, 9 and related text. In another embodiment, the well fluid may be blocked by a different structure. In an embodiment, the method 900 comprises blocking flow of well fluid between an outside of the rotatable shaft and an inside surface of the impellers.

The following are non-limiting specific embodiments in accordance with the present disclosure. In a first example, a centrifugal electric submersible pump (ESP) comprises a rotatable shaft, a series of impellers stacked on the rotatable shaft, each impeller comprising a hub secured to the rotatable shaft by a key, the series of impellers comprising an uppermost impeller and a lowermost impeller, a flanged sleeve keyed to the rotatable shaft below the lowermost impeller, and a seal disposed between the lowermost impeller and the flanged sleeve. In a second example, a centrifugal electric submersible pump (ESP) comprises a rotatable shaft, a series of impellers assembled on the rotatable shaft, each impeller comprising a hub secured to the rotatable shaft by a key, the series of impellers comprising an uppermost impeller and a lowermost impeller, a flanged sleeve assembled on and keyed to the rotatable shaft below the lowermost impeller, and a seal assembled on the rotatable shaft between the lowermost impeller and the flanged sleeve. In a third example, a centrifugal electric submersible pump (ESP) comprises a rotatable shaft, a series of impellers stacked on the rotatable shaft, each impeller comprising a hub secured to the rotatable shaft by a key, the series of impellers comprising an uppermost impeller and a lowermost impeller, a flanged sleeve keyed to the rotatable shaft below the lowermost impeller, and a seal disposed between the lowermost impeller and the flanged sleeve, wherein the seal is a separate component and not an integral part of the rotatable shaft, not an integral part of the lowermost impeller, and not an integral part of the flanged sleeve.

ADDITIONAL DISCLOSURE

The following are non-limiting, specific embodiments in accordance with the present disclosure:

A first embodiment, which is a centrifugal electric submersible pump (ESP), comprising a rotatable shaft, a series of impellers stacked on the rotatable shaft, each impeller comprising a hub secured to the rotatable shaft by a key, the series of impellers comprising an uppermost impeller and a lowermost impeller, a flanged sleeve keyed to the rotatable shaft below the lowermost impeller, and a seal disposed between the lowermost impeller and the flanged sleeve.

A second embodiment, which is the centrifugal ESP of the first embodiment, wherein the seal comprises a gasket seal.

A third embodiment, which is the centrifugal ESP of the first embodiment, wherein the seal comprises an O-ring seal.

A fourth embodiment, which is the centrifugal ESP of the first embodiment, wherein the seal comprises a lip seal.

A fifth embodiment, which is the centrifugal ESP of any of the first, the third, or the fourth embodiment, further comprising a seal sleeve disposed between the lowermost impeller and the flanged sleeve, wherein an inside surface of the seal sleeve defines a first circumferential groove and a second circumferential groove and the seal comprises a first seal disposed in the first circumferential groove and a second seal disposed in the second circumferential groove.

A sixth embodiment, which is the centrifugal ESP of the fifth embodiment, wherein the flanged sleeve comprises a standoff portion at its upper end, the lowermost impeller comprises a lower hub at its lower end, the first seal is disposed between the first circumferential groove of the seal sleeve and an outside surface of the standoff portion of the flanged sleeve, and the second seal is disposed between the second circumferential groove of the seal sleeve and an outside of the lower hub of the lowermost impeller.

A seventh embodiment, which is the centrifugal ESP of any of the first, the third, or the fourth embodiment, wherein the lowermost impeller comprises a lower hub at its lower end, an interior surface of the lower hub defines a third circumferential groove, and the seal is disposed in the third circumferential groove.

An eighth embodiment, which is the centrifugal ESP of the seventh embodiment, wherein the lower hub of the lowermost impeller defines a receptacle, the flanged sleeve comprises a standoff portion at its upper end, the standoff portion of the flanged sleeve is installed into the receptacle of the lower hub of the lowermost impeller, and the seal is disposed between the third circumferential groove and an outside of the standoff portion of the flanged sleeve.

A ninth embodiment, which is the centrifugal ESP of any of the first, the second, the third, the fourth, the fifth, the sixth, the seventh, or the eighth embodiment, wherein the flanged sleeve is an abrasion resistant (AR) flanged sleeve.

A tenth embodiment, which is the ESP of the ninth embodiment, wherein the flanged sleeve comprises a tungsten carbide composite, tungsten carbide, silicon carbide, or titanium carbide.

An eleventh embodiment, which is a centrifugal electric submersible pump (ESP), comprising a rotatable shaft, a flanged sleeve assembled onto the rotatable shaft and secured to the rotatable shaft by a key, wherein the flanged sleeve defines a groove around an inside diameter of the flanged sleeve, and a seal assembled onto the rotatable shaft and disposed between an outside diameter of the rotatable shaft and the groove around the inside diameter of the flanged sleeve.

A twelfth embodiment, which is the centrifugal ESP of the eleventh embodiment, wherein the seal comprises an O-ring seal.

A thirteenth embodiment, which is the centrifugal ESP of the eleventh embodiment, wherein the seal comprises a lip seal.

A fourteenth embodiment, which is the centrifugal ESP of any of the eleventh, the twelfth, or the thirteenth embodiment, wherein the flanged sleeve comprises a tungsten carbide composite, tungsten carbide, silicon carbide, or titanium carbide.

A fifteenth embodiment, which is a method of lifting well fluids, comprising turning a rotatable shaft by an electric motor, wherein the electric motor is part of an electric submersible pump (ESP) assembly deployed in a wellbore, turning a series of impellers stacked on the rotatable shaft by the rotatable shaft, wherein the series of impellers are part of a centrifugal pump of the ESP assembly, wherein the series of impellers comprises a lowermost impeller, and wherein each impeller is secured to the rotatable shaft by a key, turning a flanged sleeve by the rotatable shaft, wherein the flanged sleeve is disposed below the lowermost impeller and is keyed to the rotatable shaft, and blocking all or a portion of flow of well fluid between an outside of the rotatable shaft and an inside surface of the flanged sleeve.

A sixteenth embodiment, which is the method of the fifteenth embodiment, wherein the blocking all or a portion of the flow of well fluid is performed by a seal engaged with the rotatable shaft between the lowermost impeller and the flanged sleeve.

A seventeenth embodiment, which is the method of any of the fifteenth or the sixteenth embodiment, wherein the blocking all or a portion of the flow of well fluid is performed by an O-ring or a lip seal.

An eighteenth embodiment, which is the method of any of the fifteenth, the sixteenth, or the seventeenth embodiment, wherein the blocking all or a portion of the flow of well fluid is performed by a seal disposed in a first groove defined by an interior surface of a lower hub of the lowermost impeller.

A nineteenth embodiment, which is the method of any of the fifteenth, the sixteenth, the seventeenth, or the eighteenth embodiment, wherein the blocking all or a portion of the flow of well fluid is performed by a seal disposed in a second groove defined by an interior surface of a standoff portion of the flanged sleeve.

A twentieth embodiment, which is the method of any of the fifteenth, the sixteenth, the seventeenth, the eighteenth, or the nineteenth embodiment, comprising blocking all or a portion of flow of well fluid between an outside of the rotatable shaft and an inside surface of the impellers.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A centrifugal electric submersible pump (ESP), comprising:

a rotatable shaft;

a series of impellers and a series of diffusers stacked on the rotatable shaft, each impeller of the series of impellers comprising a hub secured to the rotatable shaft by a key;

a bushing secured in one of the series of diffusers and concentric with the rotatable shaft;

a flanged sleeve located above the bushing and the one of the series of diffusers, keyed to the rotatable shaft, located below one of the series of impellers, and retained by the bushing;

a seal sleeve concentric with the rotatable shaft located above the flanged sleeve and below the hub of the one of the series of impellers, wherein an inside surface of the seal sleeve defines a first circumferential groove and a second circumferential groove and the second circumferential groove is located above the first circumferential groove;

a first seal disposed between an outside of the flanged sleeve and the first circumferential groove of the seal sleeve; and a second seal disposed between an outside of the hub of the one of the series of impellers and the second circumferential groove of the seal sleeve.

2. The centrifugal ESP of claim 1, wherein the first and second seal comprise elastomeric or rubber material.

3. The centrifugal ESP of claim 1, wherein the first seal and the second seal comprise O-ring seals.

4. The centrifugal ESP of claim 1, wherein the first seal and the second seal comprise lip seals.

5. The centrifugal ESP of claim 1, wherein the first and second seal comprise silicone rubber, urethane rubber, natural rubber, or styrene-butadiene-rubber.

6. The centrifugal ESP of claim 1, wherein the flanged sleeve comprises a standoff portion at its upper end, and wherein the first seal is disposed between the first circumferential groove of the seal sleeve and an outside surface of the standoff portion of the flanged sleeve.

7. The centrifugal ESP of claim 1, wherein the first and second seal comprise ethylene propylene diene monomer rubber, butyl rubber, polyurethane or polychloroprene.

8. The centrifugal ESP of claim 1, wherein the first and second seal comprise hydrogenated nitrile, chlorosulphonated polyethylene, nitrile, fluorosilicone, or fluorocarbon.

9. The centrifugal ESP of claim 1, wherein the flanged sleeve is an abrasion resistant (AR) flanged sleeve.

10. The centrifugal ESP of claim 9, wherein the flanged sleeve comprises a tungsten carbide composite, tungsten carbide, silicon carbide, or titanium carbide.

11. A method of lifting a well fluid, comprising:

turning a rotatable shaft by an electric motor, wherein the electric motor is part of an electric submersible pump (ESP) assembly deployed in a wellbore;

turning a series of impellers stacked on the rotatable shaft by the rotatable shaft, wherein the series of impellers are part of a centrifugal pump of the ESP assembly, and wherein each impeller of the series of impellers is secured to the rotatable shaft by a key;

turning a flanged sleeve by the rotatable shaft, wherein the flanged sleeve is disposed below one of the series of impellers, the flanged sleeve is retained by a bushing secured by a diffuser located below the one of the series of impellers, and the flanged sleeve is keyed to the rotatable shaft; and blocking all or a portion of a flow of the well fluid between an inside of a seal sleeve and an outside of the one of the series of impellers and between the inside of the seal sleeve and an outside of the flanged sleeve, wherein the seal sleeve is concentric with the rotatable shaft, the seal sleeve is located above the flanged sleeve, and the seal sleeve is located below the one of the series of impellers, wherein the blocking all or the portion of the flow of well fluid is performed by an O-ring or a lip seal disposed between the inside of the seal sleeve and the outside of the flanged sleeve and performed by an O-ring or a lip seal disposed between the inside of the seal sleeve and the outside of a hub of the one of the series of impellers.

12. The method of claim 11, wherein the O-rings or lip seals comprise elastomeric or rubber material.

13. The method of claim 11, wherein the O-rings or lip seals comprise silicone rubber, urethane rubber, natural rubber, or styrene-butadiene-rubber.

14. The method of claim 11, wherein the O-rings or lip seals comprise ethylene propylene diene monomer rubber, butyl rubber, polyurethane or polychloroprene.

15. The method of claim 11, wherein the O-rings or lip seals comprise hydrogenated nitrile, chlorosulphonated polyethylene, nitrile, fluorosilicone, or fluorocarbon.

16. The method of claim 11, wherein the flanged sleeve is an abrasion resistant (AR) flanged sleeve.

17. The method of claim 11, further comprising extending a life of the key that secures the series of impellers to the rotatable shaft by blocking all or a portion of a flow of well fluid between an inside diameter of the flanged sleeve and an outside diameter of the rotatable shaft.

18. The method of claim 11, comprising blocking all or a portion of a flow of well fluid between an outside of the rotatable shaft and an inside surface of the series of impellers.

19. The method of claim 11, wherein the seal sleeve defines a first circumferential groove and the O-ring or lip seal disposed between the inside of the seal sleeve and the outside of the flanged sleeve is disposed in the first circumferential groove.

20. The method of claim 19, wherein the seal sleeve defines a second circumferential groove and the O-ring or lip seal disposed between the inside of the seal sleeve and the outside of a hub of the one of the series of impellers is disposed in the second circumferential groove.

* * * * *